United States Patent [19]

Currie

[11] Patent Number: 4,530,418

[45] Date of Patent: Jul. 23, 1985

[54] AUTOMOTIVE EXHAUST SYSTEM

[76] Inventor: Neil L. Currie, 47 Whitehall Rd., Toronto, Ontario, Canada

[21] Appl. No.: 655,986

[22] Filed: Sep. 27, 1984

Related U.S. Application Data

[63] Continuation of Ser. No. 384,041, Jun. 1, 1982, abandoned.

[51] Int. Cl.[3] ..... F01N 1/24

[52] U.S. Cl. ..... 181/227; 181/228; 181/231; 181/252; 181/258

[58] Field of Search ..... 181/227, 230, 229, 231, 181/252, 256, 258, 247, 248, 228; 55/276, 307, 308, DIG. 30

[56] References Cited

U.S. PATENT DOCUMENTS

| | | | |
|---|---|---|---|
| 821,828 | 5/1906 | Phelps . | |
| 1,094,667 | 4/1914 | Masten | 181/280 |
| 1,302,300 | 4/1919 | Brinkman . | |
| 1,388,107 | 8/1921 | Ernst . | |
| 1,505,893 | 8/1924 | Hunter et al. . | |
| 1,554,534 | 9/1925 | Straussler | 181/258 |
| 1,612,584 | 12/1926 | Hunter et al. . | |
| 2,499,018 | 2/1950 | Christiano et al. | 181/258 |
| 3,104,732 | 9/1963 | Ludlow et al. | 181/227 |
| 3,232,373 | 2/1966 | Bjork | 55/DIG. 30 |
| 3,235,003 | 2/1966 | Smith | 181/231 X |
| 3,306,395 | 2/1967 | Jettinghoff | 181/227 |
| 3,746,126 | 7/1973 | de Cardenas | 181/227 |
| 4,032,310 | 6/1977 | Ignoffo | 55/276 |
| 4,211,303 | 7/1980 | Matthews et al. | 181/248 |

*Primary Examiner*—Benjamin R. Fuller

*Attorney, Agent, or Firm*—Richards, Harris, Medlock & Andrews

[57] ABSTRACT

An improved exhaust system (24) uses the entire length of the system in which to perform the essential functions of muffling noise and converting unburned hydrocarbons. The improved exhaust system (24) performs these functions with a relatively uniform minimum diameter along its length. The exhaust system (24) includes a uniform outer diameter pipe (26) and elements (44) of porous material (46) forming a plurality of filters (50) through which the exhaust gas flows and which attenuates sonic frequency sound waves in the exhaust. The elements (44) are preferably elongate strips which may be folded into rectangular filters (60) or elliptical filters (90). The rectangular filters can be folded sufficiently to form squares and the elliptical filters to form circles. The rectangular filters define passageways (62–68) between the edges of the filters and inner wall (70) of the pipe (26) which further attenuates exhaust noise through imbalances in the gas flow. The elliptical filters maintain continuous contact with the inner surface of the pipe. In a second embodiment, an exhaust system (110) includes a liner (112) having a plurality of airfoil baffles (114) extending into the gas flow to muffle the exhaust. A third embodiment is formed by an exhaust system (130) having a woven wire fabric (132) along its interior to attenuate the exhaust sounds. All of the filters or elements can be coated with alumina and a platinum group metal for catalytic converting.

31 Claims, 26 Drawing Figures

B
C 26
46
48
54
56
60
62
64
66
68
70
72
82
84
86
88
90
94
96
98
100
102

AUTOMOTIVE EXHAUST SYSTEM

This application is a continuation of application Ser. No. 384,041, filed 6/1/82 now abandoned.

TECHNICAL FIELD

This invention relates to systems for exhausting combusted gases from internal combustion engines, and in particular for exhausting combusted gases from internal combustion engines in vehicles.

BACKGROUND ART

The exhaust gases generated by internal combustion engines such as found in vehicles are exhausted through an exhaust system. The typical exhaust system includes a relatively small diameter pipe extending from the exhaust manifold to an opening to the atmosphere with one or more muffler sections along the pipe. The typical muffler is a heavy, bulky device of much larger diameter than the remainder of the system.

The muffler is employed to break down within a relatively short distance the sonic shock waves generated by the explosive release of the combusted air/fuel mixture from the cylinders. The shock waves include sound waves of various frequencies. The muffler is designed to break up the sound waves of various frequencies by structure well understood in the art.

The large size of the muffler results in a greater likelihood of road damage and imposes space limitations which must be designed for in the vehicle. When the exhaust system cools, the large, confined space within the muffler condenses moisture, which contributes to rusting and deterioration of the muffler. A muffler is relatively complex in construction and requires several different pieces of metal to be processed in different techniques. The muffler is therefore relatively expensive and heavy.

In recent years, the exhaust system has also been required to eliminate unburned hydrocarbons from the exhaust gases. This function has been performed by a separate catalytic converter. The converter is essentially an add on to the conventional exhaust system and again forms a relatively bulky container. The exhaust gases with unburned hydrocarbons flow into the converter and are passed over catalysts from the precious metals of the platinum group, including platinum, palladium and rhodium, all plated over alumina. The alumina can be in pellet form or carried on a substrate of extruded ceramics. The converter acts to oxidize the hydrocarbons to reduce the pollutants in the atmosphere. Again, the converter's bulk requires the design of the vehicle to be specially adapted to accept the converter. The oxidation of the unburned hydrocarbons generates a great deal of heat and the converter reaches a high temperature. The vehicle must also be designed to insure no damage results from this high temperature.

The conventional muffler, converter, interconnecting pipe, exhaust pipe and tail pipe are connected by clamps and mounted on the vehicle through mounting brackets. The various components must be assembled and positioned on the vehicle on the assembly line. The relative complexity of the design results in a lengthy and costly assembly operation.

A need exists for an improved exhaust system which retains the muffling and oxidation features of the conventional muffler and converter with reduction of the size, cost and weight of the system. This would increase the flexibility of vehicle design. There is also a need to develop an improved exhaust system which reduces assembly time and material cost with equivalent or improved durability during use. A recent attempt to achieve some of these goals is the device in U.S. Pat. No. 3,746,126 issued July 17, 1973 to de Cardenas.

SUMMARY OF THE INVENTION

In accordance with one aspect of the present invention, an exhaust system for exhausting gases from an internal combustion engine having an exhaust manifold on a vehicle is provided. The system includes a uniform diameter pipe extending from the engine exhaust manifold to an opening to the atmosphere. The pipe carries the exhaust gases within from the engine to the atmosphere. A plurality of porous filters are positioned within the pipe along its length to muffle the noise of the exhaust. The porous filters are formed of at least one section of expanded metal. Each section is folded at preselected positions along its length to form individual filters between the folds with each filter spaced a predetermined distance from the filters formed by a common fold.

In accordance with another aspect of the present invention, the predetermined distance between filters is varied along the pipe to enhance the muffling of a range of sonic frequencies. The exhaust system can also include at least one section along the length of the pipe without filters to form a mixing chamber in which the separated portions of the shock wave cancel one another.

The filters can have a rectangular (including square) cross section, forming four arcuate channels between the filters and inner wall of the pipe which assist in dissipating the shock waves. The filters can have an elliptical (including circular) cross section between the folds to permit the filters to contact the inner wall of the pipe substantially about its inner circumference. The element can be twisted in a spiral shape to form the filters with the edges of the elements contacting the inner surface of the pipe.

In accordance with yet another aspect of the present invention, the porous material can be selected from the group comprising metal, ceramics or high temperature plastics. The openings in the porous material can be of varied dimensions to enhance muffling of a range of sonic frequencies and can include airfoil sections to enhance muffling. The openings can be created by expanding the material, by weaving material of linear form or by other suitable methods.

In accordance with yet another aspect of the present invention, portions of the porous material are coated with alumina and with metals from the platinum group located along the length within the pipe to oxidize unburned hydrocarbons in the exhaust. The pipe may be a continuous piece along its entire length with the porous material extending within substantially along the entire length of the pipe or with material concentrated in one or more areas.

In accordance with another aspect of the present invention, an exhaust system for exhausting gases from an internal combustion engine having an exhaust manifold on a vehicle is provided. The exhaust system includes a uniform diameter pipe extending from the engine exhaust manifold to an opening to the atmosphere. The pipe carries exhaust gases therein to the opening. At least one section of liner is positioned within the pipe as the pipe is formed, the section includes a plurality of airfoil baffles extending into the gas flow for muffling the exhaust.

In accordance with another aspect, the airfoil baffles may be selected from the group including metal, high temperature plastic and ceramics. The liner can be constructed from a continuous strip with the airfoil baffles stamped from the strip and the strip folded to form a cylinder welded along its edges within the exhaust pipe as the pipe itself is being formed and welded.

The airfoil baffles can be varied in length, section, thickness, angle of attack and frequency along the length of the liner to enhance the muffling of the exhaust system.

In yet another embodiment of the present invention, an exhaust system is provided which includes a uniform diameter pipe with woven wire fabric therein to muffle the exhaust. The wire can be of various diameters and cross sections with the resulting fabric extending along the length of the pipe to enhance muffling of a range of sonic frequencies in the exhaust.

BRIEF DESCRIPTION OF THE DRAWINGS

A more complete understanding of the invention may be had by reference to the following Detailed Description when taken in conjunction with the accompanying Drawings, wherein:

FIGS. 6A–C illustrate views of a second modification of the exhaust system with an element folded less than 180° between filter sections;

FIGS. 7A–C illustrate views of a third modification of the exhaust system having circular filters;

FIGS. 8A–C illustrate a fourth modification of the exhaust system having elliptical shaped filter portions folded less than 180° between filters;

FIGS. 9A–C illustrate a fifth modification of the exhaust system with the filter portions being formed by a spiraling expanded, woven or otherwise porous material;

DETAILED DESCRIPTION

Figure 1:
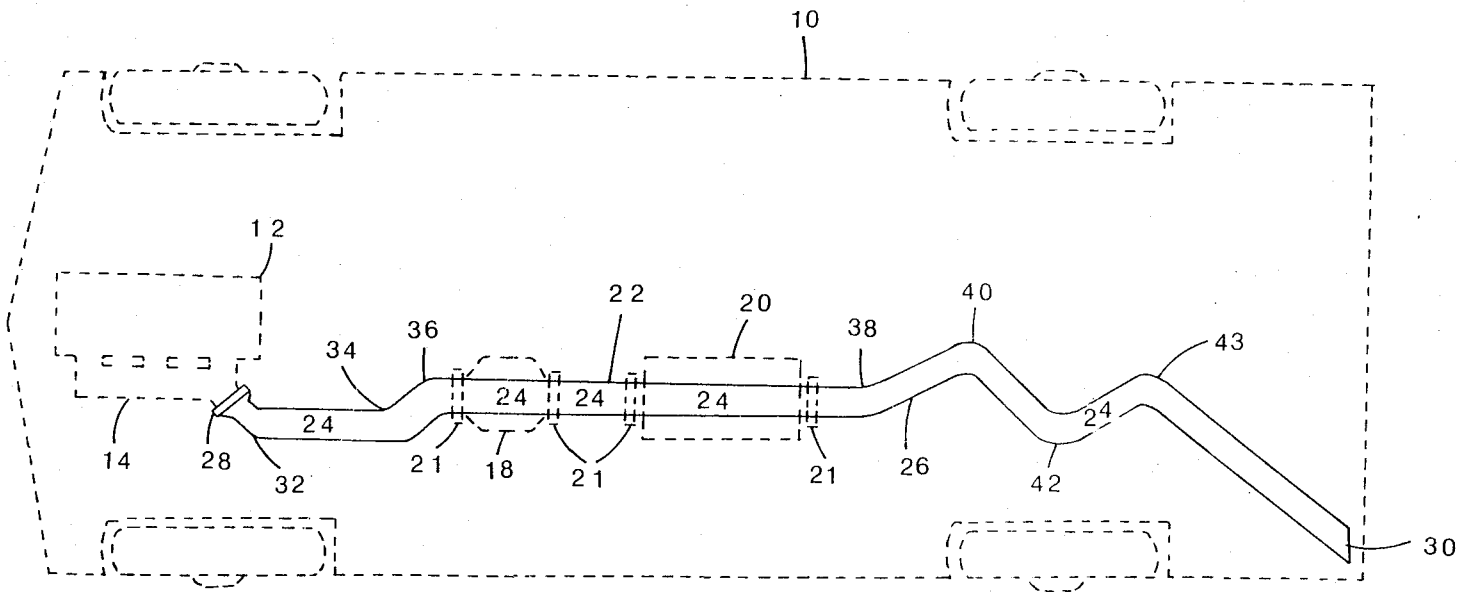
FIG. 1 is a bottom view of a vehicle having an exhaust system mounted thereon forming a first embodiment of the present invention illustrated in a solid line and a conventional exhaust system with a conventional muffler, a conventional catalytic converter and clamps illustrated by dotted lines.

Referring now to the Drawings, wherein like reference characters designate like or corresponding parts throughout several views, FIG. 1 illustrates a vehicle 10 incorporating an internal combustion engine 12 for propulsion. The engine 12 includes an exhaust manifold 14 which collects combusted exhaust gases from the engine from one or more cylinders for disposal in the atmosphere.

The components illustrated in dotted line represent a conventional muffler 20, a conventional catalytic converter 18 and conventional clamps 21. The converter and muffler are interconnected by pipe 22. It can be readily seen that the design of the vehicle 10 must be especially adapted to accommodate the relative bulk of the converter 18 and muffler 20. It can also be seen that the conventional system is made up of many parts which must be assembled concurrently or before the vehicle is assembled on the assembly line.

The exhaust system 24 illustrated in FIG. 1 forms a first embodiment of the present invention. As can be readily seen, the exhaust system includes a continuous pipe 26 having a uniform outer diameter with a flange 28 at one end for connection to the exhaust manifold 14. The opposite end of the pipe 26 has an opening 30 proximate the rear of the vehicle for exhausting the combusted gases from the engine to the atmosphere. The pipe 26 can have bends 32, 34, 36, 38, 40, 42 and 43 along its length to accommodate the construction of the vehicle, including the rear axle and other structures. As will be described in greater detail, the exhaust system 24 acts to muffle the exhaust of the engine and can also include catalytic converting elements to oxidize the unburned hydrocarbons to reduce atmospheric pollution.

Figure 2:
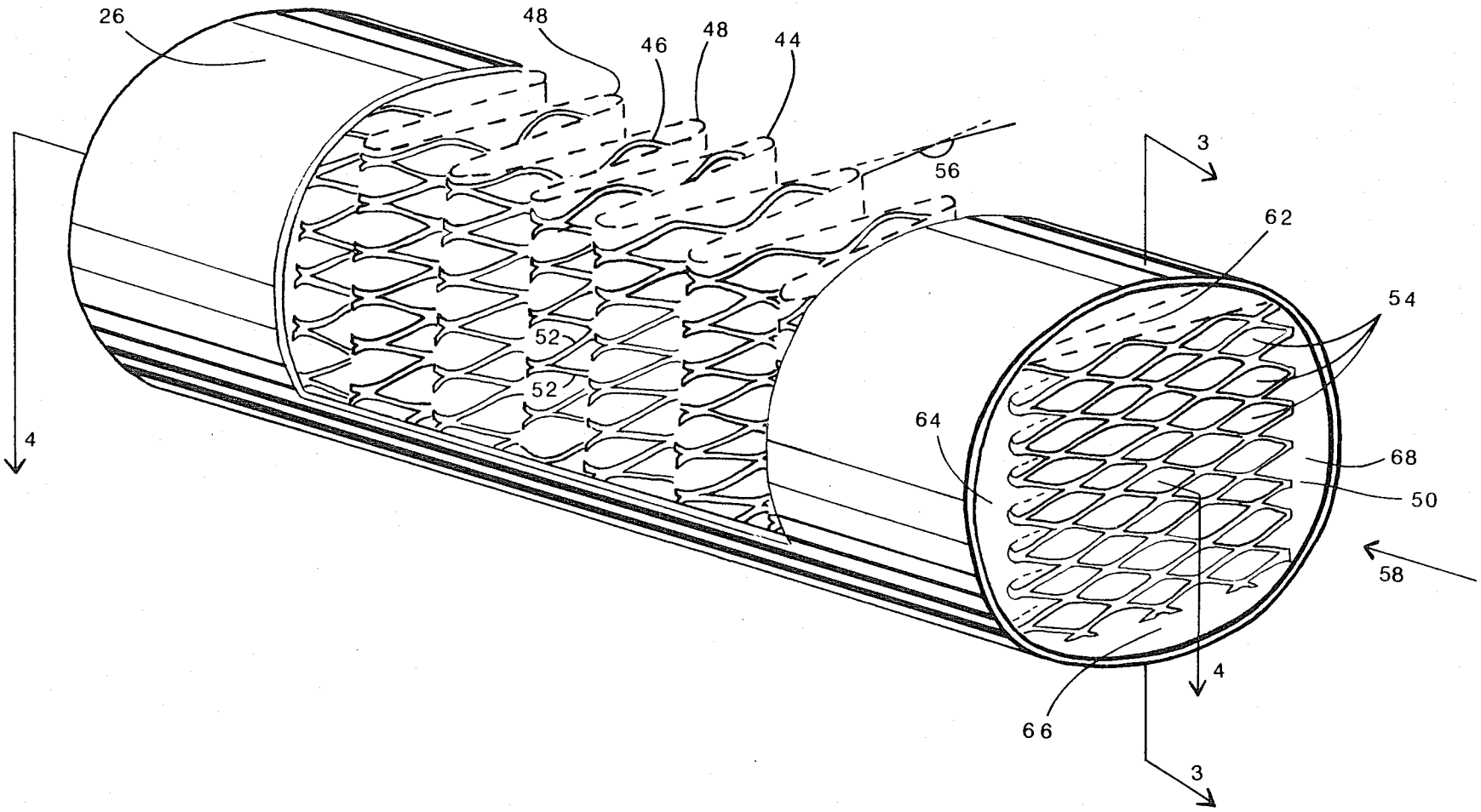
FIG. 2 is a perspective view of a portion of the exhaust system partially cut away to show the expanded material within the outer pipe.
Figure 3A:
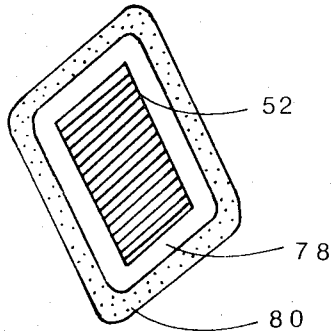
FIG. 3A is a detail of a section of the expanded material taken along line 3A—3A in FIG. 3 in the direction of the arrows.
Figure 3:
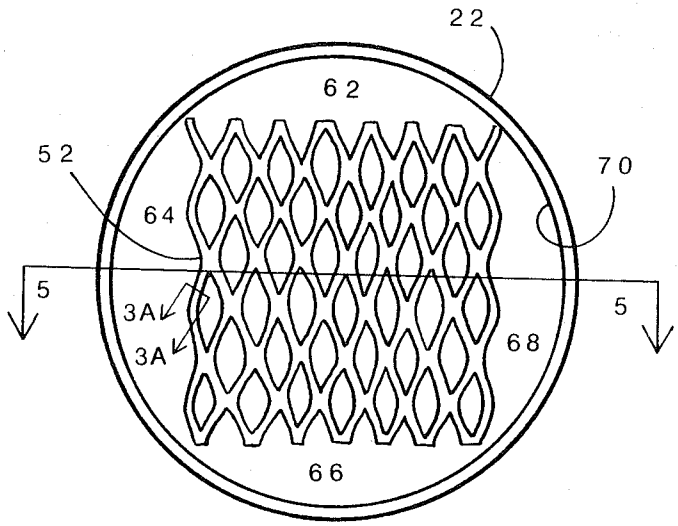
FIG. 3 is a vertical cross-sectional view of the exhaust system along line 3—3 in FIG. 2 in the direction of the arrows.
Figure 4:
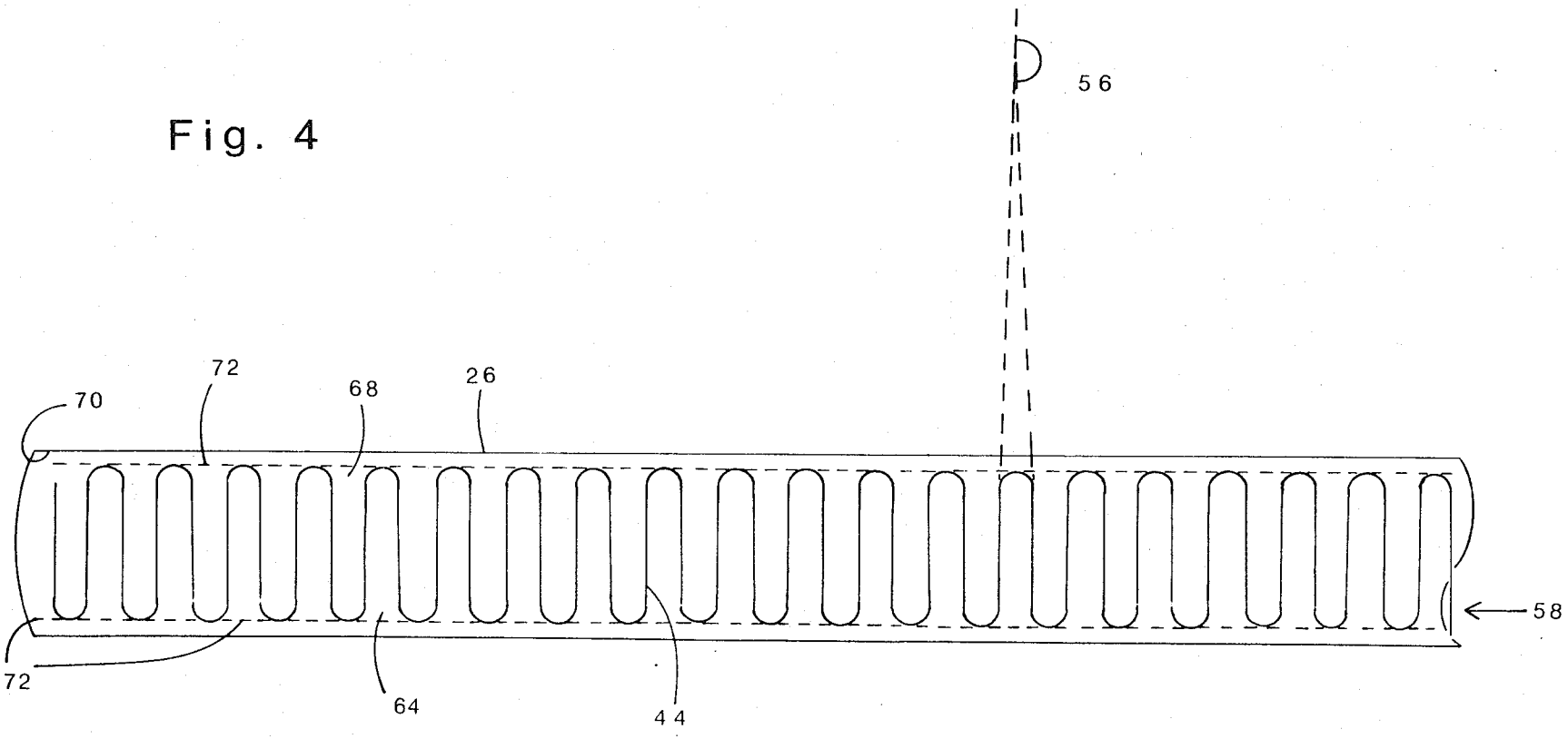
FIG. 4 is a horizontal cross section of the exhaust system taken along lines 4—4 in the direction of the arrows in FIG. 2.

The interior details of the exhaust system are best described in reference to FIGS. 2–4. FIG. 2 illustrates an element 44 of expanded porous material 46. The element 44 is folded along folds 48 to form individual spaced rectangular filters 50. The rectangular filters can be folded sufficiently to form square filters as shown. The webbing 52 of each filter 50 defines a plurality of holes 54 which permit the exhaust gases to pass through the filters. The webbing breaks up and destroys the sonic frequency shock waves in the exhaust generated by the explosive release of the combusted air/fuel mixture from the engine 12.

Figures 6A, 7, 8, 9:
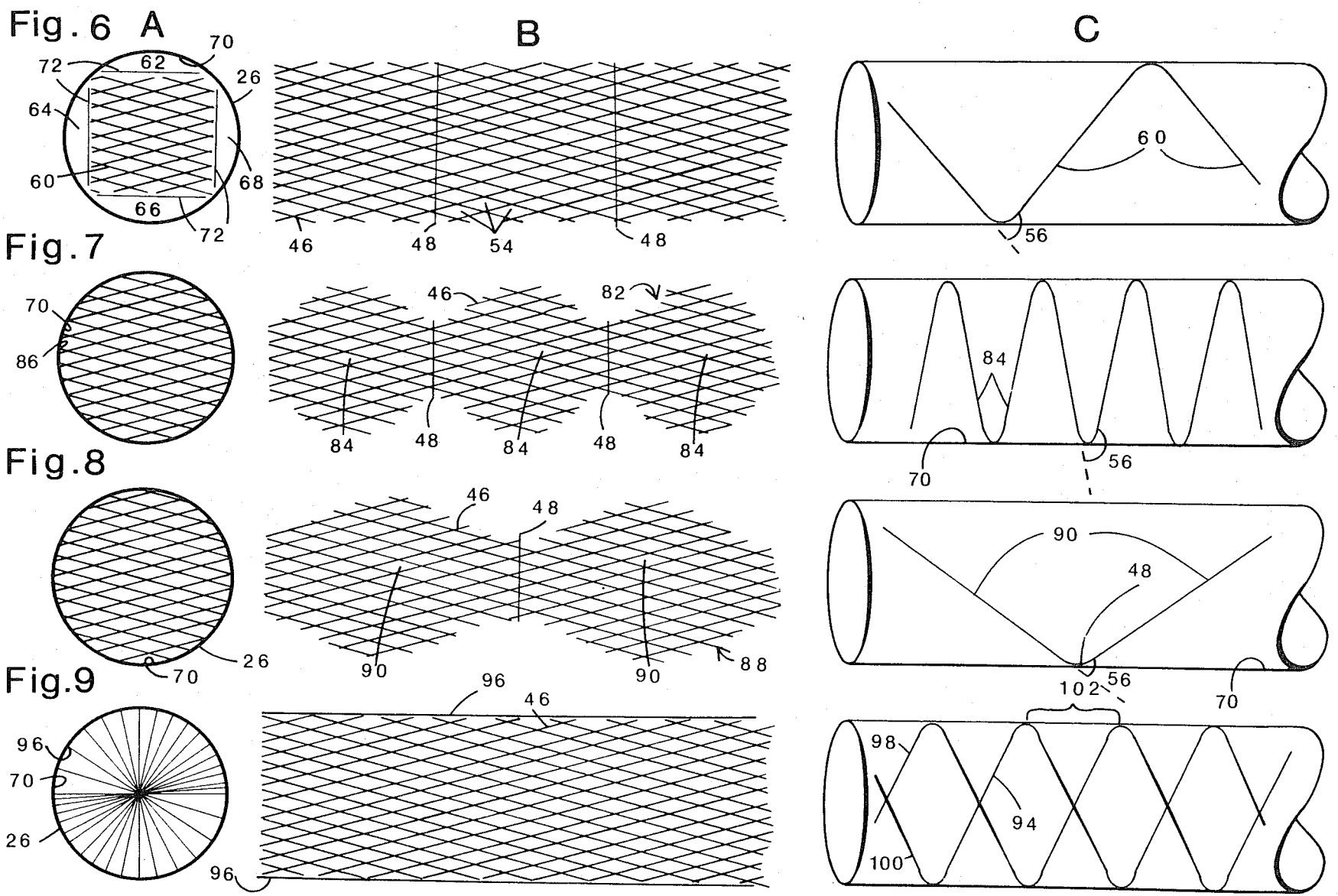
Figure 11:
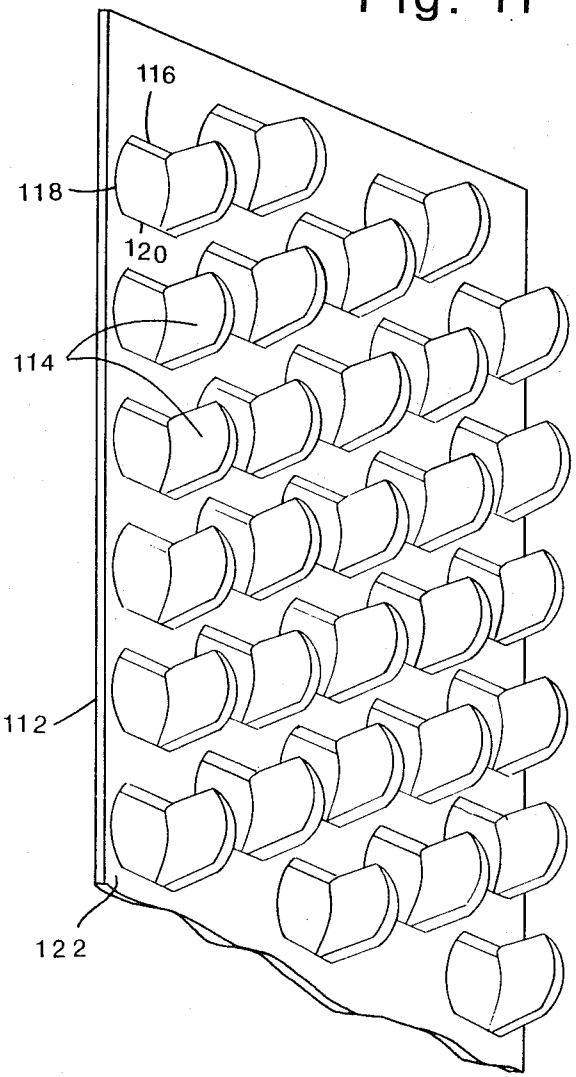
FIG. 11 illustrates a liner for use in the exhaust system forming the second embodiment.

The bending angle 56 of the folds 48 is selected to provide an optimal cross section to the filters 50. In the embodiment in FIGS. 2–4, the material is folded at angle 56 approaching 180° to provide square filters 50 transverse to the exhaust gas flow represented by the arrow 58. In a modification illustrated in FIGS. 6A–C, the bending angle 56 is folded through an angle less than 180° to provide an expanded element with rectangular filters 60 which are not transverse to the direction of gas flow. The bending angle 56 can be varied along the length of the element to enhance the muffling of a range of sonic frequencies in the exhaust flow. Steel forms the preferred material which forms the expanded material 46. However, a high temperature plastic, ceramic or other material may be used. One exhaust system constructed in accordance with the teachings of the invention employed holes 54 having a measurement of one-quarter inch by one-eighth inch and was found to satisfactorily muffle the exhaust with acceptable back pressure.

With rectangular filters 50 (including the square filters 50 shown), four arcuate passageways 62, 64, 66 and 68 are formed between the inner wall 70 of the pipe 26 and the outer edges 72 of the filters. Portions of the shock waves in the exhaust enter the passageways. The turbulent imbalances in the gas flow between the passageways and gas filtering through filters 50 enhance the disintegration of the sonic frequency shock waves and enhance the muffling.

Figure 5:
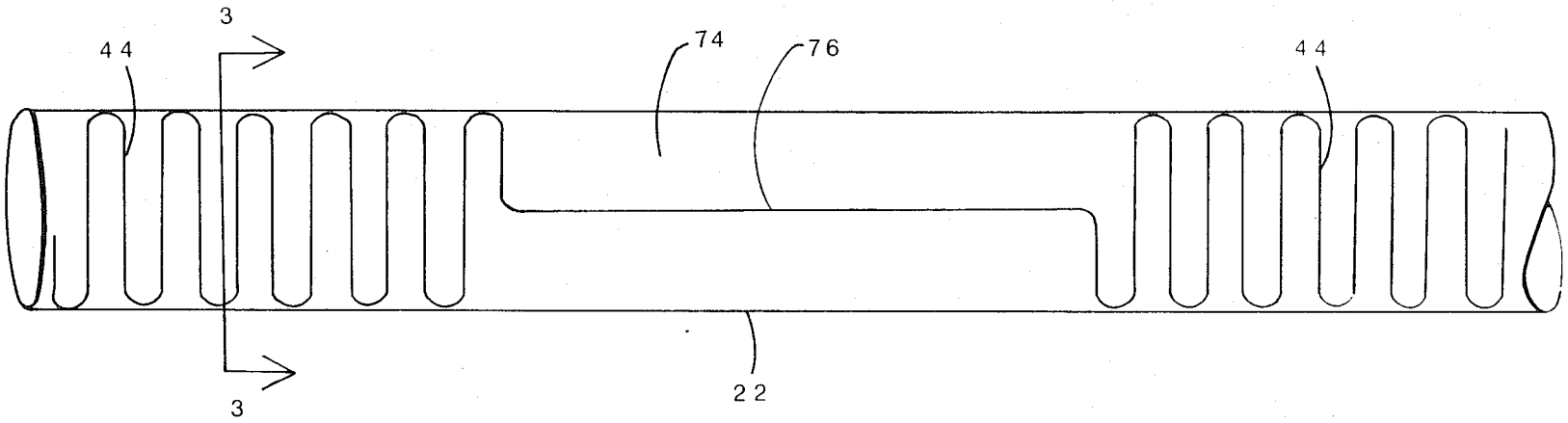
FIG. 5 is a horizontal cross-sectional view of a first modification of the exhaust system illustrating a mixing chamber.

While element 44 can fill the entire length of the pipe 26, the preferred construction is to incorporate one or more mixing chambers 74 along the length of the pipe as illustrated in FIG. 5. The mixing chamber can be formed between two elements 44 or a single continuous element may have a portion 76 extending linearly along the mixing chamber as shown in FIG. 5. The mixing chambers mix the separated portions of the disintegrating shock waves so that they cancel one another to further enhance the muffling. By having a linear section 76, the element 44 may extend through the entire length of the pipe in one continuous strip to ease manufacture. Ideally, to attenuate the maximum range of sonic frequencies, the exhaust system 24 will have a series of filters and mixing chambers, with the filters having varied hole sizes to provide attenuation of the shock waves. The pattern may be repeated along the length of the exhaust system to form several stages of targeted sonic disintegration for each frequency. The webbing 52 can also be formed with various airfoil cross-sectional shapes to move the gas within the pipe to enhance attenuation.

The exhaust system 24 can also act as a catalytic converter. Conventional catalytic converters are constructed in two basic modes. One mode is to provide a number of alumina pellets coated with a platinum group metal. The platinum group includes platinum, paladium and rhodium. In the second mode, a ceramic is coated with alumina and then with a catalyst from the platinum group. The catalyst facilitates the oxidation of the unburned hydrocarbons in the exhaust gas to reduce hydrocarbon pollution.

The webbing 52 is coated with alumina 78 and a platinum group metal 80 as best seen in FIG. 3A to perform the catalytic converting function in exhaust system 24. If steel forms expanded material 46, it is desirable to coat the steel with ceramic prior to coating with alumina and platinum group metal 80.

A second modification of exhaust system 24 is illustrated in FIGS. 7A–C. The modified exhaust system includes an element 82 formed of expanded material 46 having circular filters 84. The folds 48 between each filter 84 have been folded approximately 180° so that the circular filters are approximately transverse to the gas flow. The edges 86 of the circular filters contact the inner wall 70 so that each filter extends over the entire internal cross section of the pipe. The arcuate passageways 62–68 are therefore eliminated.

In a fourth modification of the exhaust system 24, an element 88 formed of expanded material 46 is provided which defines elliptical filters 90. The material at each fold 48 is folded less than 180° to expand the element. However, the elliptical shape of filters 90 permit each elliptical filter 90 to contact the inner wall 70 of the pipe 26 along an interior circumference oblique to the length of the pipe. Therefore, the filters are not traverse to the direction of flow. The passageways 62–68 are eliminated so that the entire gas flow must pass through each filter. The distance between the filters 90 can also be adjusted according to the length of the ellipse.

A fifth modification of exhaust system 24 is illustrated in FIGS. 9A–C and FIGS. 15 and 16. In this embodiment, an element 94 of a continuous strip of expanded material 46 having a uniform width is twisted into a spiral so that the outer edges 96 of the element contact the inner wall 70 of the pipe 26 along helical lines 98 and 100. The gas will flow through each filter 102 defined by the helical element 94 to present a plurality of porous cross sections to the gas flow extending about the entire circumference of the inner wall.

Figure 15:
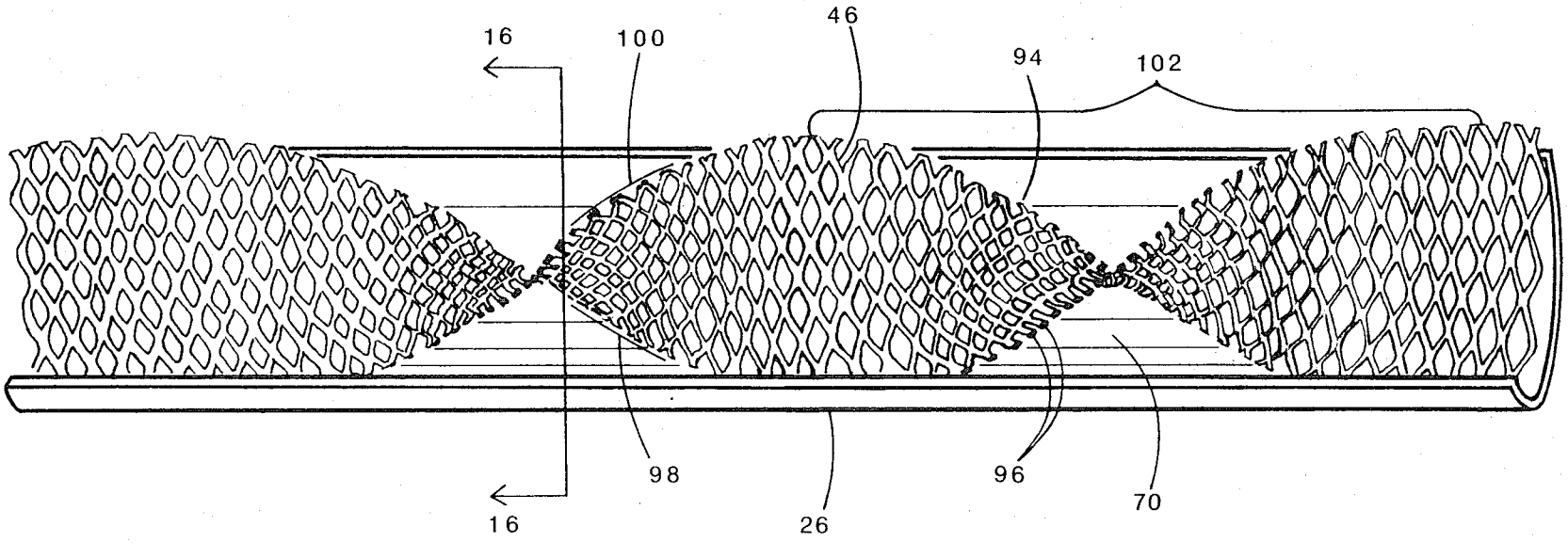
FIG. 15 is a broken away view of the fifth modification of the first embodiment illustrating the spiraling construction of the expanded material.
Figure 16:
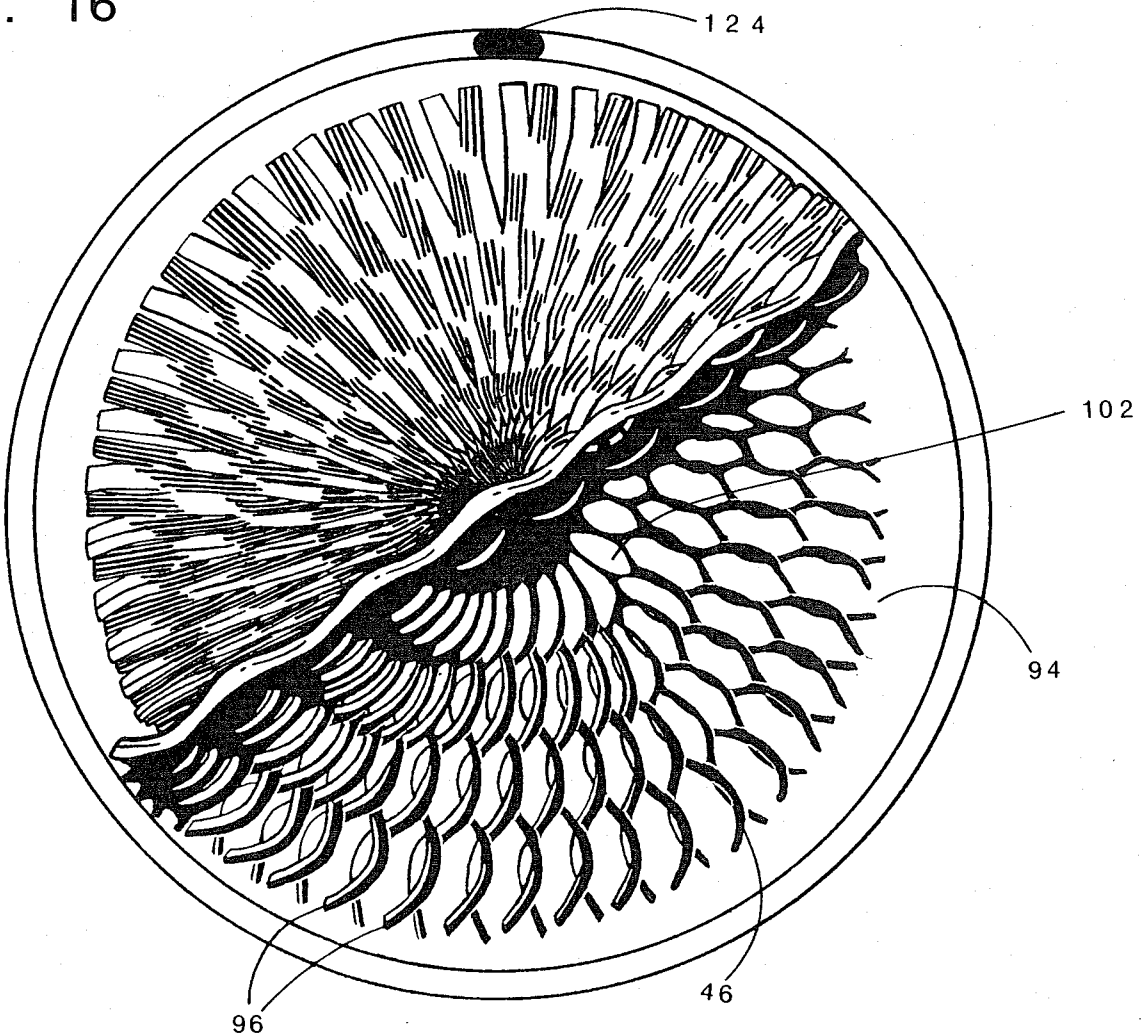
FIG. 16 is a vertical cross-sectional view of the fifth modification taken along line 16—16 in the direction of the arrows in FIG. 15.

FIG. 15 is an accurate representation of the placement of a portion of the element 94 within the pipe 26. FIG. 16 is an end view of the exhaust system having one filter 102 formed by a sufficient length of the element 94 to complete a full circumference of the inner wall.

Many advantages are achieved by the exhaust system 24. The pipe 26 in the system 24 forms a continuous muffling pipe. Experiments have shown that a pipe 26 having substantially the same outer diameter as connecting pipe 22 in a conventional system 16 and which extends the length of a conventional exhaust system 16 achieves substantially the same muffling effect as the conventional exhaust system 16. Therefore, the bulky muffler is eliminated. If the exhaust system 24 includes a catalytic converter function, the catalytic converter 18 can also be eliminated. The exhaust system 24 therefore reduces the size and weight of the exhaust system which permits increased flexibility in vehicle design including a lower profile and more streamlined and lighter vehicle. This can result in fuel savings. The smoother, less bulky profile of the system 24 also means it is less exposed to road damage.

In addition, the continuous length pipe 26 does not require the clamps typically employed in the conventional exhaust system 16. The simplicity of the exhaust system 24 can provide saving on the assembly line, reduced material costs and can result in lower back pressure for a desired muffling level.

When designed to have a catalytic converter function, the exhaust system 24 further has the advantage of dispersing the heat generation from the catalytic action along that length of the exhaust system 24 which includes the catalytic converter action. This reduces the heat build up in any particular part of the vehicle again providing more flexibility in the vehicle design. The exhaust system 24 can achieve three functions within a given length and minimum diameter while the pipe 22 of the conventional system 16 of similar diameter only carries gases. The section of pipe 26 can not only carry away gases, but muffle the exhaust sounds and remove pollutants as well.

Figure 14:
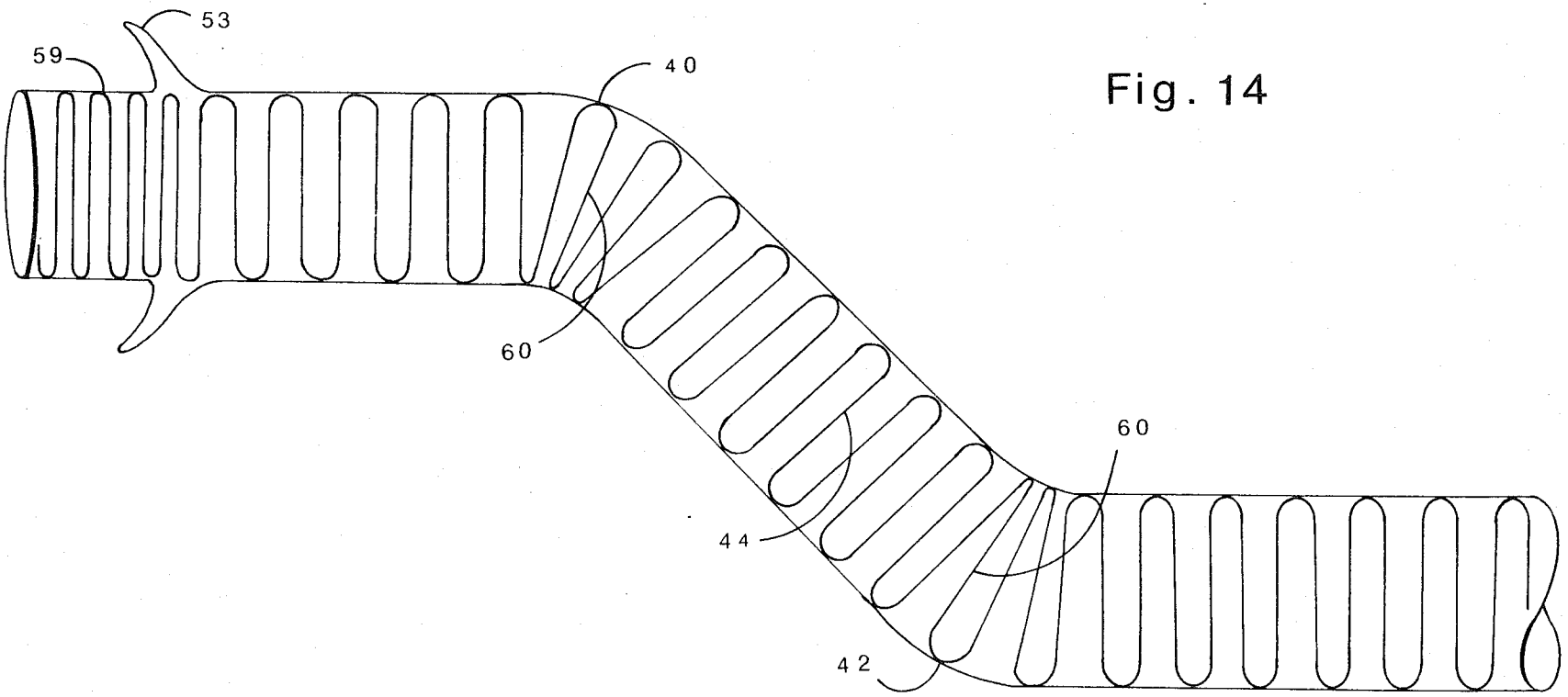
FIG. 14 illustrates a horizontal cross section of the exhaust system forming the first embodiment adapted for attachment to an exhaust manifold and bent to conform to the vehicle design, showing the minor deformation of the element that occurs when the pipe is bent or flanged.

The presence of passageway 62–68 can enhance ventilation within the exhaust system when the system is not operating. This will reduce the corrosion level below that found in conventional mufflers and permit the exhaust system 24 to be more durable in operation. The exhaust system 24 also provides great flexibility in bending to conform to the structure of the vehicle. For example, FIG. 14 illustrates the interior cross section of the exhaust system 24 at bends 40 and 42. Since the muffling action occurs over a substantial length of the exhaust system, any limited distortion or disintegration of the filters at a particular bend do not significantly effect the operation of the exhaust system. The distortion of the few filters 60 which are pressed closer together at the inner radius of the curve and fanned apart at the outer radius of the curve have no practical ill effect on the operation of the exhaust system. A few filters 59 are pressed closer together by the shortening of the pipe when the flange 53 is formed which again has no practical ill effect.

The material 46 may be formed of extruded ceramic of varying porosity and shapes which can be produced in sizes and designs to fit into the pipe 26 prior to forming of the pipe and welding of a seam on the pipe. When the pipe is bent, the ceramic elements can be broken at the flanges and bends without significant deterioration of the muffling capacity of the exhaust system.

The exhaust system 24 can be manufactured in various grades to suit the displacement of the internal combustion engine with which it is to be used, the length of pipe to be installed, the muffling characteristics desired, the degree of back pressure which will be tolerated and the level of pollution control required. Since the muffling and catalytic converter functions are separate, the exhaust system 24 can be used solely for muffling or solely for pollution control. However, both muffling and catalytic conversion can be combined in the same exhaust system 24.

It can also be desirable to construct the exhaust system 24 in more than one section. This may be desirable for ease of assembly. In addition, this permits the assembly of one section of the exhaust system employed solely for muffling with another section employed solely as a catalytic converter. The muffling and conversion sections can then be replaced independently. It is also possible that the muffling and catalytic converting sections will not occupy the entire length of pipe 26. The weight of the exhaust system may be reduced by eliminating unnecessary material within the pipe. It is also possible to provide expanded material within the exhaust system 24 which is comprised of more than one material. For example, steel may be used in the muffling section while ceramic employed in the catalytic converter section. The ideal mode of production is one in which the pipe for muffling and catalytic converting can be manufactured in a continuous manner and in a continuous form, or in a continuously repeating series of forms, and designed so that all parts would reach the end of their service life at the same time.

Sound level tests were made to compare the muffling effects of a conventional exhaust system, an exhaust system incorporating a muffler as disclosed in U.S. Pat. No. 3,746,126, issued July 17, 1973 to de Cardenas and an exhaust system constructed in accordance with the teachings of the present invention. Sound level tests were also made with a single five foot length of empty pipe and with no muffler or pipe whatsoever. All tests were made on a General Motors V8 engine having a displacement of 283 cubic inches. A Genrad Model 1983 sound level meter was used in all measurements on the "fast" response mode.

All tests were conducted under identical conditions in a home garage. The sound level meter was mounted on a tripod approximately midway between the side of the automobile and one wall of the garage, about four feet from the open end of the exhaust system. In every case, the exhaust systems tested were mounted after the Y or cross over junction which joins exhaust pipe sections from the two exhaust manifolds into a common pipe immediately ahead of the position of the conventional muffler.

The muffler constructed under the teachings of the de Cardenas patent was constructed of a length of galvanized sheet steel such as used in roof flashing from which a strip was cut of width equal to the inside diameter of a two inch OD exhaust pipe. The sheet steel was twisted into a helix five feet in length and inserted into a five foot length of two inch OD pipe.

Table 1 summarizes the sound level readings from a conventional muffler at various engine speeds with the automatic transmission provided on the test vehicle in park and drive positions.

TABLE 1

| | CONVENTIONAL MUFFLER | |
|---|---|---|
| R.P.M. | dB (A) in park | dB (A) in drive |
| 500 | — | 68 |
| 600 | 70 | 71 |
| 800 | 72 | 73 |
| 1000 | 73 | 78 |
| 1200 | 77 | — |
| 2000 | 80 | — |
| 2500 | 84 | — |

The sound readings for the muffler constructed in accordance with the teachings of the de Cardenas patent are recorded in Table 2.

TABLE 2

| | De CARDENAS MUFFLER | |
|---|---|---|
| R.P.M. | dB (A) in park | dB (A) in drive |
| 500 | — | 78 |
| 600 | 76 | 81 |
| 800 | 80 | 88 |
| 1000 | 82 | 94 |
| 1200 | 84 | — |
| 2000 | 88 | — |
| 2500 | 90 | — |

The sound level results with a muffling pipe constructed in accordance with the present invention are tabulated in Table No. 3.

TABLE 3

| | PRESENT INVENTION | |
|---|---|---|
| R.P.M. | dB (A) in park | dB (A) in drive |
| 500 | — | 71 |
| 600 | 72 | 74 |
| 800 | 75 | 78 |
| 1000 | 77 | 84 |
| 1200 | 78 | — |
| 2000 | 81 | — |
| 2500 | 84 | — |

The sound level measurements with a hollow or empty five foot length of pipe are tabulated in Table No. 4.

TABLE NO. 4

| EMPTY FIVE FOOT LENGTH OF PIPE | | |
|---|---|---|
| R.P.M. | dB (A) in park | dB (A) in drive |
| 500 | — | 80 |
| 600 | 77 | 83 |
| 800 | 80 | 89 |
| 1000 | 85 | 95 |
| 1200 | 85 | — |
| 2000 | 89 | — |
| 2500 | 90 | — |

The sound level measurements when no pipe or muffler is provided after the Y junction are tabulated in Table No. 5.

TABLE NO. 5

| NO PIPE OR MUFFLER | | |
|---|---|---|
| R.P.M. | dB (A) in park | dB (A) in drive |
| 500 | — | 79 |
| 600 | 78 | 84 |
| 800 | 80 | 90 |
| 1000 | 81 | 96 |
| 1200 | 83 | — |
| 2000 | 90 | — |
| 2500 | 92 | — |

Sound levels measured in rapid acceleration to 3,000 R.P.M. are recorded below.

| Sound Level | Conventional Muffler | Present Invention | de-Cardenas Muffler | Empty five Foot Length of Pipe | No pipe or Muffler |
|---|---|---|---|---|---|
| dB (A) | 93 | 96 | 103 | 103 | 106 |

The exhaust system 110 illustrated in FIGS. 10–13 forms a second embodiment of the present invention. The exhaust system 110 includes the pipe 26 having a substantially uniform outer diameter over its entire length. However, a liner 112 is positioned inside the pipe 26 which includes a plurality of airfoil baffles 114 projecting inwardly from the liner 112 into the gas flow to break up and disintegrate the sonic shock waves. The liner 112 is preferably constructed of a metal such as steel. The airfoil baffles 114 can be stamped from the continuous strip of liner material 112 shown in FIG. 11 by cutting the material along edges 116, 118 and 120 and bending the baffle 114 created thereby in one direction so that all the baffles extend from one side 122 of the liner 112.

Figure 10:
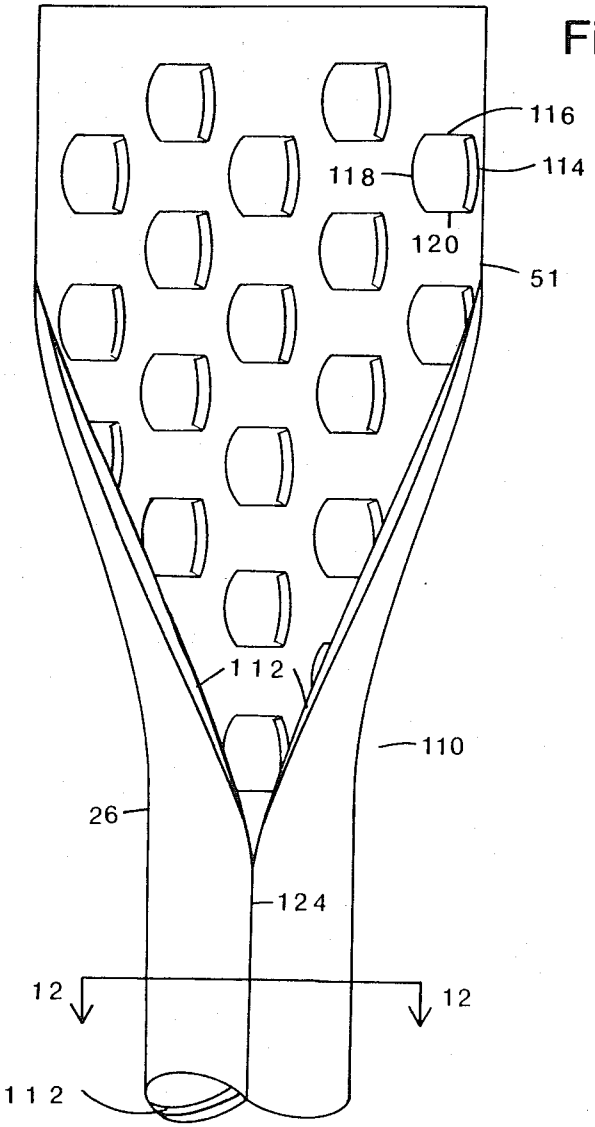
FIG. 10 illustrates an exhaust system forming a second embodiment of the present invention with a portion unfolded to illustrate the interior construction, showing a plurality of baffles extending into the gas flow.

The pipe 26 and liner 112 can then be simultaneously rolled into tube form as shown in FIG. 10. When rolled, the pipe is welded along seam 124 to form a gas tight exhaust system. If desired, both the pipe and liner can be welded.

Figure 12:
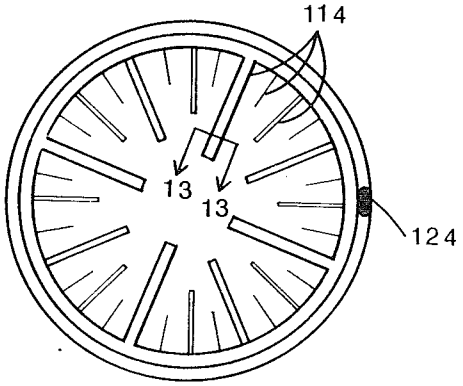
FIG. 12 illustrates a vertical cross section of the exhaust system forming a second embodiment along line 12—12 in the direction of the arrows in FIG. 10.

The baffles 114 in the rolled liner extend radially inward toward the center of the exhaust system as best seen in FIG. 12. The baffles can extend entirely across the inner diameter of the rolled liner or any lesser distance desired.

Figure 13:
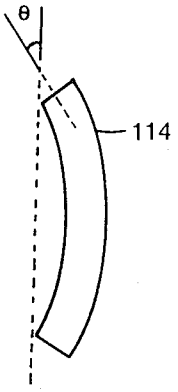
FIG. 13 illustrates the cross section of an airfoil section taken along line 13—13 in the direction of the arrows in FIG. 12.

The individual baffles 114 are shaped to form an airfoil surface as best seen in FIG. 13. The airfoil surface breaks up the gas flow to attenuate the sonic frequencies of the shock wave. The baffles can vary in their airfoil sections, their lengths, their thickness and their angle of attack 8 to the gas flow as well as their frequency along the length of the exhaust system. If a catalytic conversion function is desired, the baffles can be coated with alumina and a platinum group metal to perform the converting function.

The exhaust system 110 includes the advantages noted above with regard to exhaust system 24. Exhaust system 110 can also be used in substantially the same manner as the exhaust system 24 described above.

Figure 17:
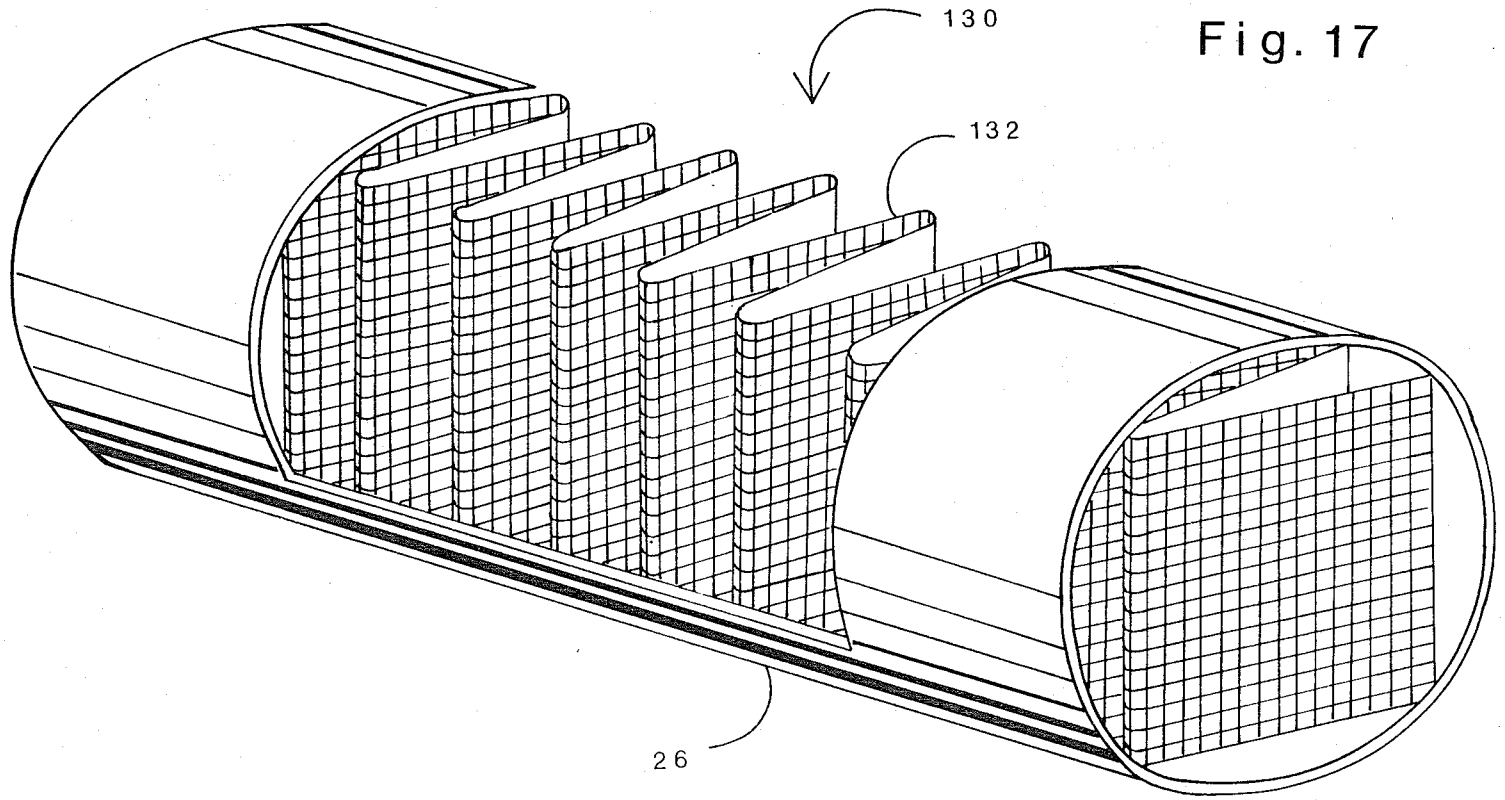
FIG. 17 is a partial cut-away view of a third embodiment of the present invention using woven material.

In FIG. 17, exhaust system 130 forms a third embodiment of the present invention. In the exhaust system 130, the pipe 26 is filled with woven wire fabric 132. The woven wire fabric acts to attenuate the sonic frequencies of the shock wave in the exhaust in a manner similar to the systems 24 and 110 described above. The warp of the woven fabric can be of wires of varying diameters and cross sections. The weft in the fabric can also be similarly varied. Open spaces between the wires in the fabric can be varied in size and shape along the length thereof to increase the attenuation across a range of sonic frequencies. The exhaust system 130 also provides the advantages and uses of systems 24 and 110 mentioned above.

While several embodiments of the present invention have been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. An exhaust system for exhausting gases from an internal combustion engine having an exhaust manifold on a vehicle, the engine being capable of conventional muffling by at least one muffler section positioned along the length of an exhaust pipe extending from the exhaust manifold to the atmosphere, the muffler section having a larger diameter than the diameter of the exhaust pipe, comprising:

a uniform diameter pipe having a diameter approximately that of the exhaust pipe for conventional muffling extending from the engine exhaust manifold to an opening to the atmosphere, the pipe carrying the exhaust gases from the engine to the atmosphere; and a plurality of expanded, porous material filters positioned within the pipe along its length to muffle the noise of the exhaust, said filters being formed of at least one element of porous material, said element being folded at preselected positions along the length of said element to form individual filters between the folds with each filter spaced a predetermined distance from the proximate filters.

2. The exhaust system of claim 1 wherein the predetermined distance between proximate filters varies along the length of said pipe to enhance muffling of a range of sonic frequencies in the exhaust system.

3. The exhaust system of claim 1 wherein said pipe includes at least one section along its length without filters to form a mixing chamber where portions of sonic frequency shock waves that have been subdivided by previous filters cancel one another.

4. The exhaust system of claim 1 wherein said filters have a rectangular cross section, forming four arcuate channels along the length of said pipe between the inner wall thereof and the edges of said filters to assist in dissipation of the sonic frequency shock waves.

5. The exhaust system of claim 1 wherein said filters have an elliptical cross section to permit said filters to contact the inner wall of said pipe about the entire circumference of said filter.

6. The exhaust system of claim 1 wherein said at least one element comprises a strip of porous material having a uniform width equal to the inner diameter of said pipe, said element being twisted into a spiral shape for placement within said pipe to form said filters.

7. The exhaust system of claim 1 wherein said porous material is formed from a material selected from a group comprising metal, ceramics and high temperature plastics.

8. The exhaust system of claim 1 wherein said porous material is an expanded steel having openings approximately $\frac{1}{4}$ by $\frac{1}{8}$ inch.

9. The exhaust system of claim 1 wherein said porous material includes webbing having an airfoil shape for altering the gas flow to attenuate sonic frequency shock waves.

10. The exhaust system of claim 1 wherein said uniform diameter pipe is a continuous length from the exhaust manifold to the opening into the atmosphere.

11. The exhaust system of claim 1 wherein the openings in said porous material vary in size along the length of said pipe to attenuate a range of sonic frequency shock waves.

12. The exhaust system of claim 1 wherein said porous material includes webbing having alumina and a platinum group metal plated thereon to form a catalytic converter within the exhaust system.

13. The exhaust system of claim 1 wherein said porous material is plated with a substance selected from the group comprising alumina and a platinum group metal.

14. An exhaust system for exhausting gases from an internal combustion engine having an exhaust manifold on a vehicle, the engine being capable of conventional muffling by at least one muffler section positioned along the length of an exhaust pipe extending from the exhaust manifold to the atmosphere, the muffler section having a larger diameter that the diameter of the exhaust pipe, comprising:

a uniform diameter pipe having a diameter approximately that of the exhaust pipe for conventional muffling extending from the engine exhaust manifold to an opening to the atmosphere, the pipe carrying the exhaust gases from the engine to the atmosphere; and a plurality of porous material filters having openings therethrough positioned within the pipe along its length to muffle the noise of the exhaust, said material filters being formed of at least one element of porous material, said element being folded at preselected positions along the length of said element to form individual filters between adjacent folds with each of said filters spaced a predetermined distance from the filters formed on either side thereof sharing a common fold, portions of said porous material being coated with alumina and a platinum group metal to form a catalytic converter section for oxidizing unburned hydrocarbons in the exhaust gases.

15. The exhaust system of claim 14 wherein the predetermined distances between filters varies to enhance muffling of a range of sonic frequency shock waves in the exhaust system.

16. The exhaust system of claim 14 wherein the interior of at least one portion of said pipe is not provided with filters to form an empty mixing chamber for mixing and cancellation of separated portions of shock waves therein.

17. The exhaust system of claim 14 wherein said element has a generally uniform width and is folded at folds an angle not exceeding 180° to form rectangular cross section filters, said element forming four arcuate channels between the edges of each filter and the inner wall of said pipe to permit exhaust gases to flow therethrough, the pressure and imbalances between the flow through said filters and said channels further attenuating sonic frequency shock waves.

18. The exhaust system of claim 14 wherein the width of said element varies to form elliptical cross-sectional filters with varying angles of the fold so that the edges of each of said filters contacts the inner wall of said pipe along an elliptical curve.

19. The exhaust system of claim 14 wherein said element has a uniform width and is twisted to form a spiral for inclusion within said pipe.

20. The exhaust system of claim 14 wherein said porous material is selected from the group of materials comprising metal, ceramics and high temperature plastics.

21. The exhaust system of claim 14 wherein said filters are formed by webbing, the webbing forming said filters having an airfoil cross section exposed to the gas flow for altering the gas flow to further attenuate sonic frequency shock waves.

22. The exhaust system of claim 14 wherein said expanded material is formed of expanded steel, the openings in said expanded steel having dimensions approximately $\frac{1}{4}$ by $\frac{1}{8}$ inch.

23. The exhaust system of claim 14 wherein said uniform diameter pipe is a continuous length from the exhaust manifold to the opening into the atmosphere.

24. The exhaust system of claim 14 wherein the openings in said porous material vary in size along the length of said pipe to attenuate target frequencies across a range of sonic frequency shock waves.

25. The exhaust system of claim 14 wherein said pipe comprises at least two sections, a first section being predominantly for muffling the exhaust and the second section being predominantly for reducing the hydrocarbons in the exhaust gases.

26. The exhaust system of claim 17 wherein said element is folded to form square cross section filters.

27. The exhaust system of claim 18 wherein said element is folded to form circular cross section filters.

28. An exhaust system for exhausting gases from an internal combustion engine having an exhaust manifold on a vehicle, the engine being capable of conventional muffling by at least one muffler section positioned along the length of an exhaust pipe extending from the exhaust manifold to the atmosphere, the muffler section having a larger diameter than the diameter of the exhaust pipe, comprising:

a uniform diameter pipe having a diameter approximately that of the exhaust pipe for conventional muffling extending from the engine exhaust manifold to an opening to the atmosphere, the pipe carrying within exhaust gases from the engine to the atmosphere; and a plurality of porous metal filters having a webbing and openings therebetween positioned within the pipe along its length to muffle the noise of the exhaust, said filters being formed of at least one elongate strip element of expanded metal, said element being folded at preselected positions along its length to form individual filters between the folds, adjacent filters being separated by the folds, selected ones of said filters having webbing coated with alumina and a platinum group metal to perform a catalytic conversion function, said element being of uniform width and defining filters of rectangular cross section upon folding to form four arcuate channels between the inner wall of said pipe and edges of said filters to further attenuate sonic frequency shock waves, the openings between the webbing of said filters being approximately $\frac{1}{4}$ by $\frac{1}{8}$ inch.

29. An exhaust system for exhausting gases from an internal combustion engine having an exhaust manifold on a vehicle, the engine being capable of conventional muffling by at least one muffler section positioned along the length of a conventional exhaust pipe extending from the exhaust manifold to the atmosphere, the muffler section having a larger diameter than the diameter of the exhaust pipe, the vehicle being specifically constructed to mount an exhaust pipe of said diameter, comprising:

a uniform diameter single walled pipe having a diameter no greater than approximately that of the conventional exhaust pipe, said uniform diameter pipe extending from the engine exhaust manifold to an opening to the atmosphere, the uniform diameter pipe carrying within exhaust gases;

muffling means within the uniform diameter pipe for muffling the exhaust, the muffling means extending continuously along the entire length of the uniform diameter pipe so that the entire length of the uniform diameter pipe has a muffling effect on the exhaust; and the single walled uniform diameter pipe being sized to fit in the vehicle without redesign of the vehicle configuration as a result of the uniformity between the outer diameter of the uniform diameter pipe and the conventional exhaust pipe.

30. The exhaust system of claim 29 wherein said muffling means comprises a woven wire fabric, the wire in said woven wire fabric varying in diamater in cross section to attenuate a range of sonic frequency shock waves, the openings between wires also being varied in size to attenuate a range of sonic frequency shock waves.

31. The exhaust system of claim 29 wherein said muffling means is coated with alumina and a platinum group metal.

* * * * *

UNITED STATES PATENT AND TRADEMARK OFFICE

CERTIFICATE OF CORRECTION

PATENT NO. : 4,530,418

DATED : July 23, 1985

INVENTOR(S) : Neil L. Currie

It is certified that error appears in the above-identified patent and that said Letters Patent is hereby corrected as shown below:

Column 9, line 66, change "8" to --θ--.

Signed and Sealed this

*Twelfth* Day of *November 1985*

[SEAL]

*Attest:*

DONALD J. QUIGG

*Attesting Officer*

*Commissioner of Patents and Trademarks*